US005865635A

United States Patent [19]

Hsiang et al.

[11] Patent Number: 5,865,635

[45] Date of Patent: Feb. 2, 1999

[54] SAFETY SOCKET

[76] Inventors: Yu-Lung Hsiang, No.10, Yeong An Street, Yeong Her City, Taipei Hsien; Liang-Jung Liu, 3F.,No.2,Alley 2,Lane 252,Sec. 4,Shin Hay Rd., Taipei; Chih-Ching Chen, 3F.,No. 22,Lane 165,Yan Jyi Street, Tuu Cherng City,Taipei Hsien, all of Taiwan

[21] Appl. No.: 988,295

[22] Filed: Dec. 10, 1997

[51] Int. Cl.[6] ..... H01R 29/00

[52] U.S. Cl. ..... 439/188; 200/51.09

[58] Field of Search ..... 439/188, 135; 200/51.09

[56] References Cited

U.S. PATENT DOCUMENTS

| | | | |
|---|---|---|---|
| 5,066,238 | 11/1991 | Shieh | 439/137 |
| 5,113,045 | 5/1992 | Crofton | 200/51.09 |
| 5,186,639 | 2/1993 | Comerci et al. | 200/51.09 |
| 5,320,545 | 6/1994 | Brothers | 200/51.09 |
| 5,347,095 | 9/1994 | Zeder | 200/51.09 |

*Primary Examiner*—Steven L. Stephan
*Assistant Examiner*—T C Patel
*Attorney, Agent, or Firm*—Pro-Techtor International Services

[57] ABSTRACT

A safety socket for avoiding danger of shock due to insertion of alien article into the insertion hole. The socket is disposed with three spaced partitioning boards defining three apartments. The partitioning boards are arranged according to the direction of the arrangement of the insertion holes of the socket. Three wedge-shaped insulative slide boards are disposed on the partitioning boards, which are left and right slidable within the apartments. Three short leaf springs and three sets of leaf spring seats are respectively disposed in the apartments. A leaf spring extends from each leaf spring seat to contact with a corresponding short leaf spring. The slide board is restricted to resiliently reciprocally slide within a slot formed on the leaf spring seat. By means of the leaf spring, when the plug is not inserted into the socket, the short leaf spring or the leaf spring always pushes the slide board in a direction reverse to the corresponding leaf spring, whereby the leaf spring is normally in an open state. Reversely, when the plug is inserted into the socket, each two corresponding leaf springs contact with each other into a powered on state. When an alien article is inserted into one insertion hole, the alien article will push the slide board on one side to move, whereby the insertion hole on the other side is powered on, while the insertion hole on the insertion side is not powered on so as to avoid danger of shock.

1 Claim, 4 Drawing Sheets

SAFETY SOCKET

BACKGROUND OF THE INVENTION

The present invention relates to a safety socket for avoiding danger of shock due to insertion of alien article into the insertion hole.

A domestic socket is mounted on a wall for a plug to insert therein to (including 220 V three hole type socket and 110 V two hole type socket). The internal structure of the socket includes two adjacent conductive leaf springs disposed in each insertion hole. The insertion plate of the plug is inserted into the space between the leaf springs to achieve electric connection. According to such arrangement, in case a conductive alien article such as an iron wire or an iron plate is inserted into any of the insertion holes by an innocent person such as a child, the person may be shocked and injured. Therefore, the conventional socket lacks any safety design for avoiding the danger of shock.

SUMMARY OF THE INVENTION

It is therefore a primary object of the present invention to provide a safety socket for avoiding danger of shock due to insertion of alien article into the insertion hole so as to ensure safety. The safety socket of the present invention includes a base seat of the socket is disposed with three sets of partitioning boards spaced from each other. The partitioning boards are arranged according to the direction of the arrangement of the insertion holes of the socket. Three sets of wedge-shaped insulative slide boards are disposed on the partitioning boards, which are left and right slidable within the apartments defined by the partitioning boards. In addition, three sets of short leaf springs and three sets of leaf spring seats are respectively disposed in the apartments or on the base seat. A leaf spring extends from each leaf spring seat to contact with a corresponding short leaf spring. The slide board is restricted to resiliently reciprocally slide within a slot formed on the leaf spring seat. By means of the resilient force of the leaf spring, when the plug is not inserted into the socket, the short leaf spring or the leaf spring always pushes the slide board in a direction reverse to the corresponding leaf spring, whereby the leaf spring is normally in an open state. Reversely, when the plug is inserted into the socket, each two corresponding leaf springs contact with each other into a powered on state. In the case that an alien article is inserted into one insertion hole on one side, the alien article will push the slide board on one side to move, whereby the insertion hole on the other side is powered on, while the insertion hole on the insertion side is not powered on so as to avoid danger of shock. It is known from research that a child often inserts the alien article into one insertion hole on single side rather than both insertion holes or three insertion holes. Therefore, when the alien article is inserted into the insertion hole on one side, the slide board is forced to move to the other side, whereby only the leaf springs of the insertion hole on the other side are electrically connected, while the insertion hole on the insertion side is still not powered on. Therefore, the danger of shock due to insertion of the alien article can be effectively avoided.

The present invention can be best understood through the following description and accompanying drawings, wherein:

DETAILED DESCRIPTION OF THE PREFERRED EMBODIMENTS

Figure 1:
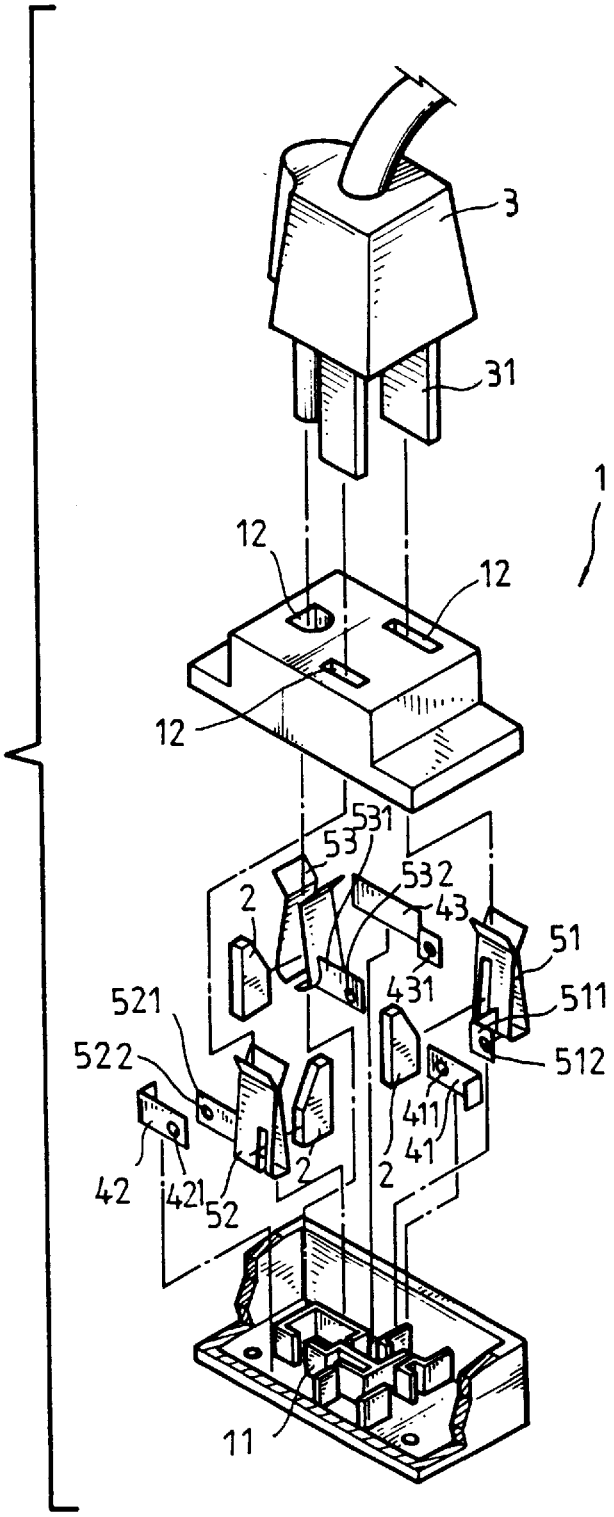
FIG. 1 is a perspective exploded view of the present invention.
Figure 2:
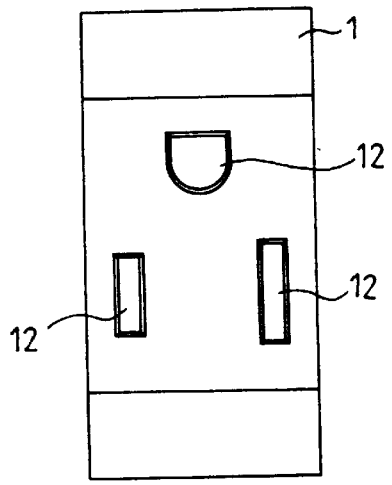
FIG. 2 is a plane view of a three hole type socket of the present invention.
Figure 3:
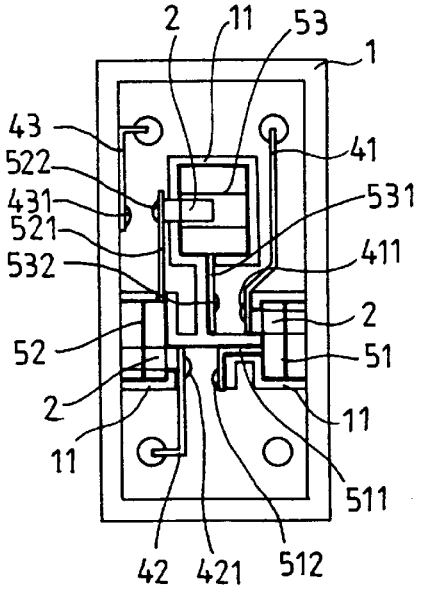
FIG. 3 is a plane view of the three hole type socket of the present invention, showing the internal structure thereof.

Please refer to FIGS. 1 to 3. The safety socket 1 of the present invention includes a base seat disposed with three sets of partitioning boards 11 spaced from each other. The partitioning boards 11 are arranged according to the positions of the insertion holes 12 of the socket 1. In cooperation with the housing of the socket 1, the partitioning boards 11 define three sets of substantially close rectangular apartments. A side wall of each apartment is formed with a window in which an insulative slide board 2 is disposed. The slide board 2 is substantially wedge-shaped, having an upper slope face for the insertion plate 31 of a plug 3 to push and slide left and right within the apartment. Three sets of short leaf springs 41, 42, 43 are disposed on the base seat. The fixed ends of the leaf springs are disposed at three dimensional positions of the base seat of the socket 1 with different curved shapes. The free ends thereof are substantially parallel to the apartment face. The short leaf springs 41, 42 are respectively attached to the openings of two lateral apartments for the slide boards 2 to protrude outside. The leaf springs resiliently abut against and retract the slide boards 2 into the apartment. The other short leaf spring 43 is solely attached to one wall end of the socket 1. Also, the free ends of the short leaf springs 41, 42, 43 are disposed with projecting contact points 411, 421, 431 for movably electrically contacting with the projecting contact points 512, 522, 532 of the leaf springs 511, 521, 531 extending from the leaf spring seats 51, 52, 53. The main body of each of the leaf spring seats 51, 52, 53 is designed as a clip having an upper opening aligned with the insertion hole 12 of the socket 1 and fixed in the apartment. The main body of each of the leaf spring seat 51, 52, 53 is formed with a slot for the slide board 2 to pass therethrough and left and right slide therewithin. In addition, from one side of each of the leaf spring seats 51, 52, 53 extend another leaf spring 511, 521, 531 corresponding to the short leaf spring 41, 42, 43. By means of the movement of the slide board 2, the leaf springs are controlled to movably electrically contact with each other so as to connect/disconnect the power. The free end of the leaf spring 531 of the leaf spring seat 53 resiliently abuts against one slide board 2, whereby the slide board 2 can be slided to push the leaf spring 531 to movably contact with the short leaf spring 43.

Figure 4:
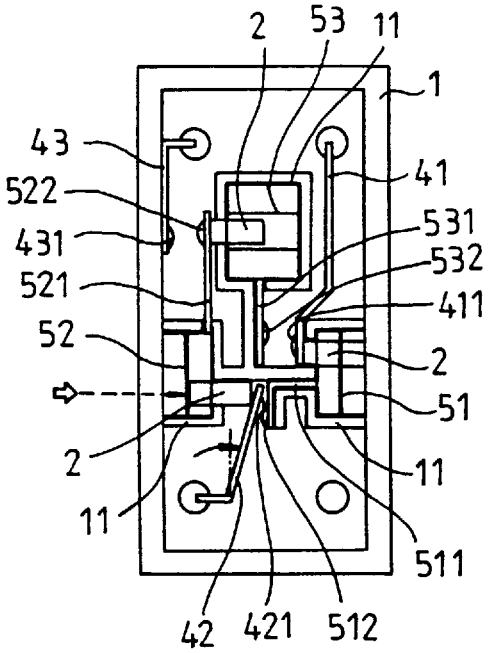
FIG. 4 shows that an alien article is inserted into one insertion hole on one side.
Figure 5:
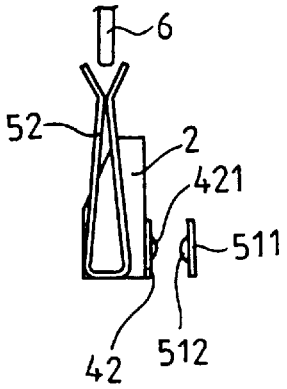
FIG. 5 is a side view showing that an alien article is inserted into one insertion hole on one side of the socket.
Figure 6:
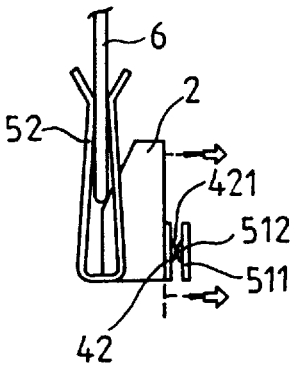
FIG. 6 is a side view according to FIG. 5, showing that the slide board is pushed right by the alien article.

Please refer to FIGS. 4 to 6 which show the operation of the present invention. In the case that an alien article 6 is inserted into one insertion hole 12 of the socket 1, the article 6 is passed into the clip-like leaf spring seat 52 to push the wedge-shaped slide board 2. Accordingly, the slide board 2 is slided out of the apartment to resiliently push the short leaf spring 42, making the projecting contact point 421 thereof contact with the projecting contact point 512 of the leaf spring 511 of the leaf spring seat 51 on the other side, whereby the insertion hole 12 on this side is powered on (as shown in FIGS. 5 and 6). That is, in the case that an alien article of a child is inserted into the insertion hole 12 of one side of the socket 1, the insertion hole 12 of the original insertion side is still powered off, while the insertion hole 12 of the other side is powered on so that the safety of the child is not threatened. Similarly, when the plug 3 is inserted into the socket 1 (as shown in FIG. 1), the three dimensions are simultaneously powered on as a general socket.

Figure 7:
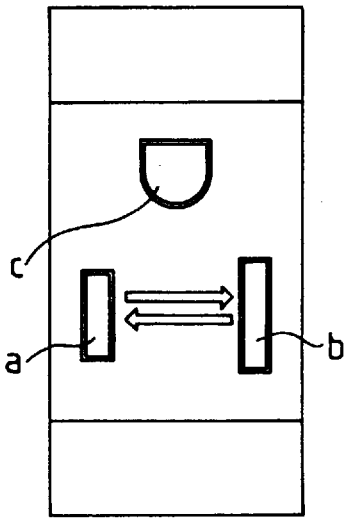
FIG. 7 shows a first mode of the electric connection of the present invention.
Figure 8:
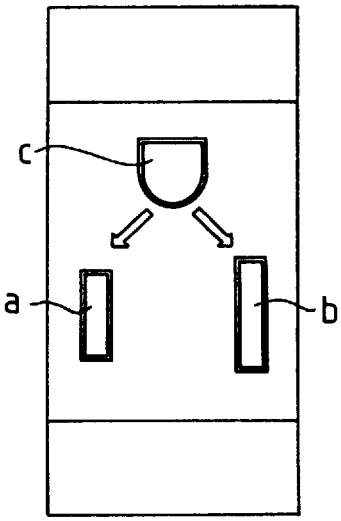
FIG. 8 shows a second mode of the electric connection of the present invention.
Figure 9:
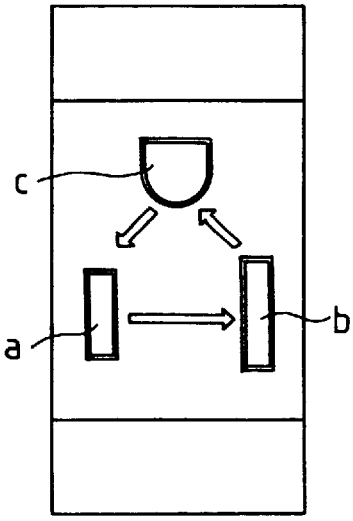
FIG. 9 shows a third mode of the electric connection of the present invention.

Finally, please refer to FIGS. 7 to 9 which show the possible assembly of the present invention. The internal structure of the socket 1 can be modified as necessary so as to change the direction of the electric connection. Referring to FIG. 7, when an alien article is inserted into the insertion hole a, the insertion hole b is powered on, while when inserted into the insertion hole b, the insertion hole a is powered on. As shown in FIG. 8, when an alien article is inserted into the insertion hole c, the insertion hole a or b is powered on. As shown in FIG. 9, when an alien article is inserted into the insertion hole a, the insertion hole b is powered on, while when inserted into the insertion hole b, the insertion hole c is powered on and when inserted into the insertion hole c, the insertion hole a is powered on. Therefore, according to the structure of the present invention, many aspects of arrangements are achievable for avoiding shock danger due to insertion of alien article into the insertion hole.

The above embodiments are applicable to three hole type socket. However, with respect to the two hole type 110 V socket used in Asian countries can be manufactured according to the similar principle.

It is to be understood that the above description and drawings are only used for illustrating some embodiments of the present invention, not intended to limit the scope thereof. Any variation and derivation from the above description and drawings should be included in the scope of the present invention.

What is claimed is:

1. A safety socket comprising a housing having a base seat disposed with three sets of partitioning boards spaced from each other, the partitioning boards being arranged according to positions of insertion holes of the socket, the partitioning boards defining three substantially close rectangular apartments, a side wall of each of said apartment being formed with a window in which an insulative slide board is disposed, the slide board being substantially wedge-shaped, having an upper sloped face for insertion of a plate of a plug to push the slide board left and right within the apartment;

three short leaf springs, including a first, a second and a third short leaf springs, being disposed on the base seat and each having one end fixed to the housing and the other end being free, the fixed ends of the leaf springs being disposed at three positions of the base seat of the socket with different curved shapes, the free ends thereof being substantially parallel to the apartment face, the short leaf spring being respectively attached to the slide boards protruding from openings of two lateral apartments, the leaf springs resiliently abutting against and retracting the slide boards into apartments; a fourth short leaf spring being attached solely attached to one wall of the socket; and three leaf spring contacts, including a first, a second and a third leaf spring contacts, disposed in respective rectangular apartments, each leaf spring contact comprising a main body and a leaf spring portion, the body of each of the leaf spring contact being designed as a clip having an upper opening aligned with the respective insertion hole of the socket and fixed in the apartment, the main body of each of the leaf spring contact being formed with a slot for the side board to pass therethrough and slide left and right therewithin;

from one side of each of the leaf spring contact extends a leaf spring portion corresponding to the short leaf spring, the leaf spring portion being provided with a projecting contact;

whereby upon insertion of the plate of the plug into the first leaf spring contact and by means of the movement of the slide board, the leaf spring projecting contact point is movably and electrically connected with a projecting contact of the second leaf spring portion so as to connect the power to the second leaf spring contact and thus upon insertion of three plates of the insertion plug, all the leaf spring contacts are electrically connected to an external power source and upon insertion of only one plate of the insertion plug, the leaf spring contact into which the plate is inserted is not powered.

* * * * *